US008680417B2

(12) United States Patent
Nakajima et al.

(10) Patent No.: US 8,680,417 B2
(45) Date of Patent: Mar. 25, 2014

(54) OPERATION APPARATUS

(75) Inventors: Hirokatsu Nakajima, Yokkaichi (JP); Satoru Chaen, Yokkaichi (JP)

(73) Assignee: Sumitomo Wiring Systems, Ltd., Mie (JP)

( * ) Notice: Subject to any disclaimer, the term of this patent is extended or adjusted under 35 U.S.C. 154(b) by 0 days.

(21) Appl. No.: 13/642,016

(22) PCT Filed: Feb. 22, 2011

(86) PCT No.: PCT/JP2011/000971

§ 371 (c)(1), (2), (4) Date: Oct. 18, 2012

(87) PCT Pub. No.: WO2011/148541

PCT Pub. Date: Dec. 1, 2011

(65) Prior Publication Data

US 2013/0032463 A1 Feb. 7, 2013

(30) Foreign Application Priority Data

May 26, 2010 (JP) ..... 2010-120111

(51) Int. Cl.
*H01H 19/14* (2006.01)

(52) U.S. Cl.
USPC ..... 200/564

(58) Field of Classification Search
USPC ..... 200/564, 336, 61.54, 61.55, 4, 5 R, 14, 200/17 R, 18, 1 B, 339, 61.56, 61.57, 553, 200/6 A, 520
See application file for complete search history.

(56) References Cited

U.S. PATENT DOCUMENTS

| | | | | |
|---|---|---|---|---|
| 2,759,371 | A * | 8/1956 | White | 74/567 |
| 3,184,557 | A * | 5/1965 | Clarey | 200/4 |
| 3,612,789 | A * | 10/1971 | Marquis et al. | 200/47 |
| 7,501,722 | B2 | 3/2009 | Shitanaka et al. | |

FOREIGN PATENT DOCUMENTS

| | | |
|---|---|---|
| JP | 54-131135 | 9/1979 |
| JP | 61-172419 | 10/1986 |
| JP | 3-48818 | 10/1991 |
| JP | 2007-080778 | 3/2007 |
| JP | 2007-214006 | 8/2007 |
| JP | 2008-041654 | 2/2008 |

OTHER PUBLICATIONS

International Search Report, mail date is May 17, 2011.

* cited by examiner

*Primary Examiner* — Edwin A. Leon
(74) *Attorney, Agent, or Firm* — Greenblum & Bernstein P.L.C.

(57) ABSTRACT

An operation apparatus inhibits separation of a holding member for holding an operation knob from a circuit board. A holding member holding a rotation operation knob so as to be rotatable includes a latched portion capable of insertion through a through-hole formed on a circuit board and also capable of flexure deformation in a specified line parallel to the circuit board. On a rear end of the latched portion, a latched projection is provided projecting to a first direction of the specified line. Accompanying flexure deformation of the latched portion in a second direction opposite to the first direction, the latched projection is able to pass through the through-hole by displacing a predetermined amount in the second direction. The rear cover includes a deformation regulator contacting the latched projection from the second direction and regulates displacement of the latched projection in the second direction to less than the pre-determined amount.

8 Claims, 7 Drawing Sheets

OPERATION APPARATUS

FIELD OF THE INVENTION

The present invention relates to an operation apparatus having a rotation operation knob that is rotated.

BACKGROUND OF THE INVENTION

Conventionally, an operation apparatus including a rotation operation knob that is rotated is provided in an instrument panel and the like of an automobile. When the rotation operation knob is rotated, an operation target such as temperature or an amount of air flow of an air conditioner is operated.

For example, Related Art 1 discloses an operation apparatus 501, as shown in FIG. 8. The operation apparatus 501 includes a circuit board 520, an operation knob 540, a holder 550, and a holding member 560 (a base in Related Art 1). A switch element is mounted on the circuit board 520. The operation knob 540 operates the switch element by being rotated. The holder 550 is connected to the operation knob 540 so as to be integrally rotatable with the operation knob 540. The holding member 560 is latched to the circuit board 520 and also holds the holder 550 and the operation knob 540 so as to be capable of rotation. A plurality of through-holes 522 are formed on the circuit board 520, running through both surfaces thereof. The holding member 560 has a plurality of latched portions 567. The latched portions 567 are inserted through the through-holes 522 and extend in a front-back direction of the circuit board 520. A latched projection 567b is provided to an end of the latched portion 567 on a reverse side. The latched projection 567b projects outward in a rotation diameter direction of the operation knob 540. In a state where the latched portion 567 is inserted through the through-hole 522, the latched projection 567b contacts the surface on the reverse side of the circuit board 520 from the reverse side. The holding member 560 is latched to the circuit board 520 via this contact.

In the conventional operation apparatus 501, the latched portion 567 is inserted through the through-hole 522 on the circuit board 520 and the latched projection 567b on the latched portion 567 contacts the surface on the reverse side of the circuit board 520. Then, the holding member 560 is latched to the circuit board 520 via this contact. Therefore, setting dimensions for the latched projection 567b and the through-hole 522 is difficult. For example, in a case where a hole diameter of the through-hole 522 is made smaller and the latched projection 567b is set so as to be forcibly pushed into the through-hole 522, the work of inserting the latched projection 567b through the through-hole 522 becomes challenging. In other words, the work of attaching the holding member 560 to the circuit board 520 becomes challenging. Meanwhile, in a case where the hole diameter of the through-hole 522 is made larger, the work of attaching the holding member 560 to the circuit board 520 becomes easier. However, in such a case, the latched projection 567b becomes able to easily pass through the through-hole 522. Therefore, in such a case, after the holding member 560 is attached to the circuit board 520, there is a risk that the latched projection 567b may pass through the through-hole 522. In other words, there is a risk that the latched projection 567b will escape to an obverse side of the circuit board 520 and the holding member 560 will separate from the circuit board 520.

RELATED ART

Patent Literature

Related Art 1: Japanese Patent Laid-open Publication No. 2008-41654

SUMMARY OF THE INVENTION

An object of the present invention is to provide an operation apparatus which facilitates attachment of a holding member to a circuit board and in which separation of the holding member from the circuit board is inhibited.

In order to accomplish this objective, the operation apparatus of the present invention includes a panel; a circuit board on which a through-hole is formed passing through both surfaces thereof, the circuit board positioned on a reverse side of the panel in a state where a switch element is mounted to the circuit board; a rotation operation knob which is rotated centered on a predetermined rotation axis and which thereby operates the switch element; a holding member which includes a latched portion extending in a front-back direction of the circuit board and capable of being inserted through the through-hole formed on the circuit board and which also holds the rotation operation knob so as to be capable of rotation; and a rear cover attached to the panel so as to cover the circuit board from the reverse side. The latched portion has a shape capable of flexure deformation in a specified line parallel to the circuit board and includes a latched projection on an end on a reverse side thereof projecting in a first direction of the specified line. Accompanying flexure deformation of the latched portion in a second direction of the specified line, the second direction being opposite to the first direction, the latched projection is able to pass through the through-hole by displacing a predetermined amount in the second direction of the specified line. In addition, the latched projection has a shape which is latched to the circuit board by contact from the reverse side with the reverse surface of the circuit board accompanying elastic recovery by the latched portion after passage through the through-hole. The rear cover has a deformation regulator which projects toward the reverse surface of the circuit board and which is capable of contact with the latched projection from the second direction of the specified line. In a state where the latched projection is latched to the circuit board and where the rear cover is attached to the panel, the deformation regulator regulates displacement of the latched projection in second direction of the specified line to less than the pre-determined amount by contact with the latched projection.

According to such an operation apparatus, the holding member is attached to the circuit board by the latched projection being inserted through the through-hole in a state where the latched portion is flexure deformed. Therefore, the work of attaching the holding member to the circuit board becomes easier. Moreover, the deformation regulator on the rear cover regulates passage of the latched projection through the through-hole. Accordingly, separation of the holding member from the circuit board is more reliably inhibited.

MODE FOR CARRYING OUT THE INVENTION

A preferred embodiment of the present invention is described with reference to the drawings.

Figure 1:
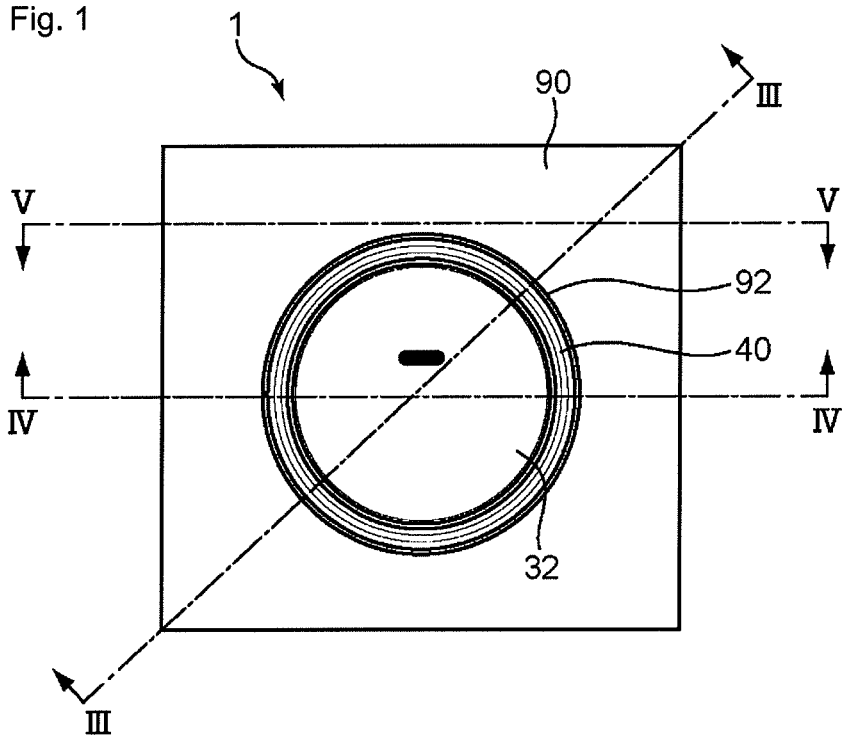
FIG. 1 is a schematic front view illustrating a state in which an operation apparatus according to an embodiment of the present invention is installed in a panel member.
Figure 2:
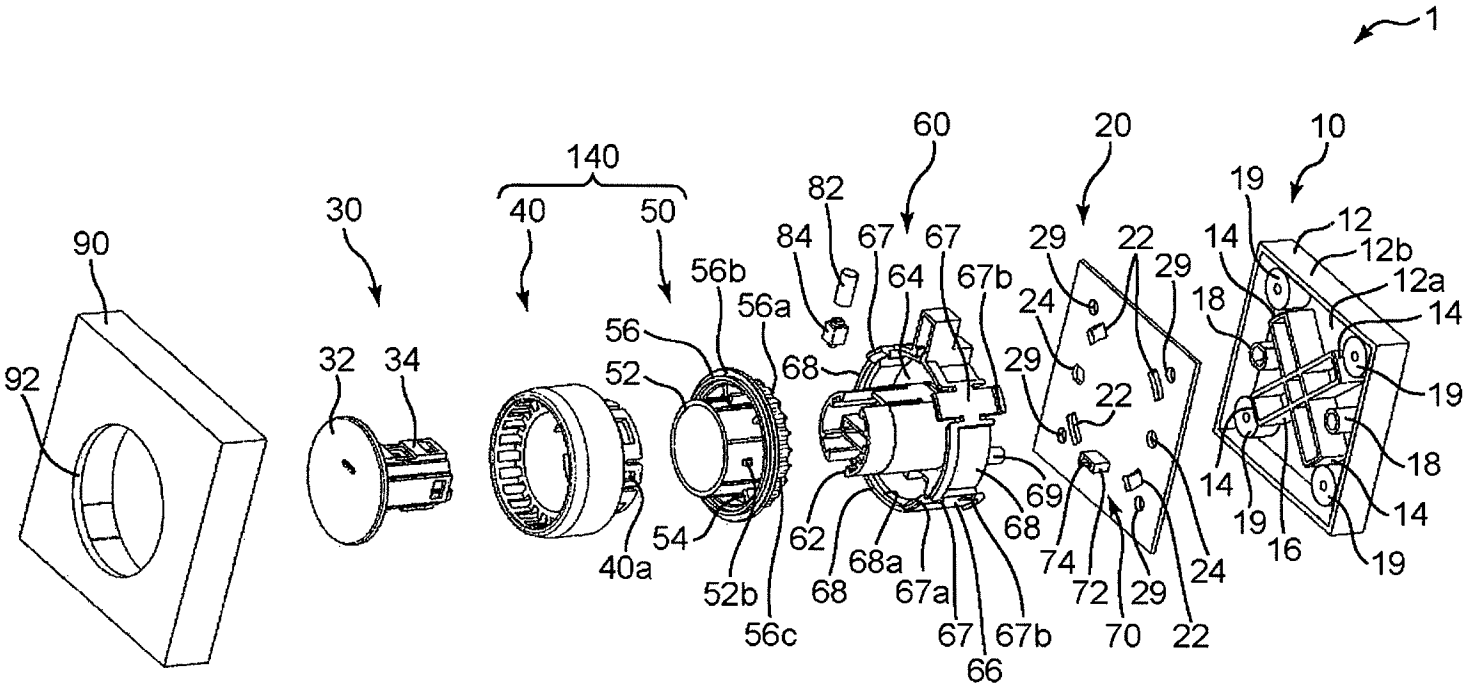
FIG. 2 is a schematic exploded perspective view of the operation apparatus shown in FIG. 1.

FIG. 1 is a front view of an operation apparatus 1 according to an embodiment of the present invention. FIG. 2 is a schematic exploded perspective view of the operation apparatus 1.

Figure 3:
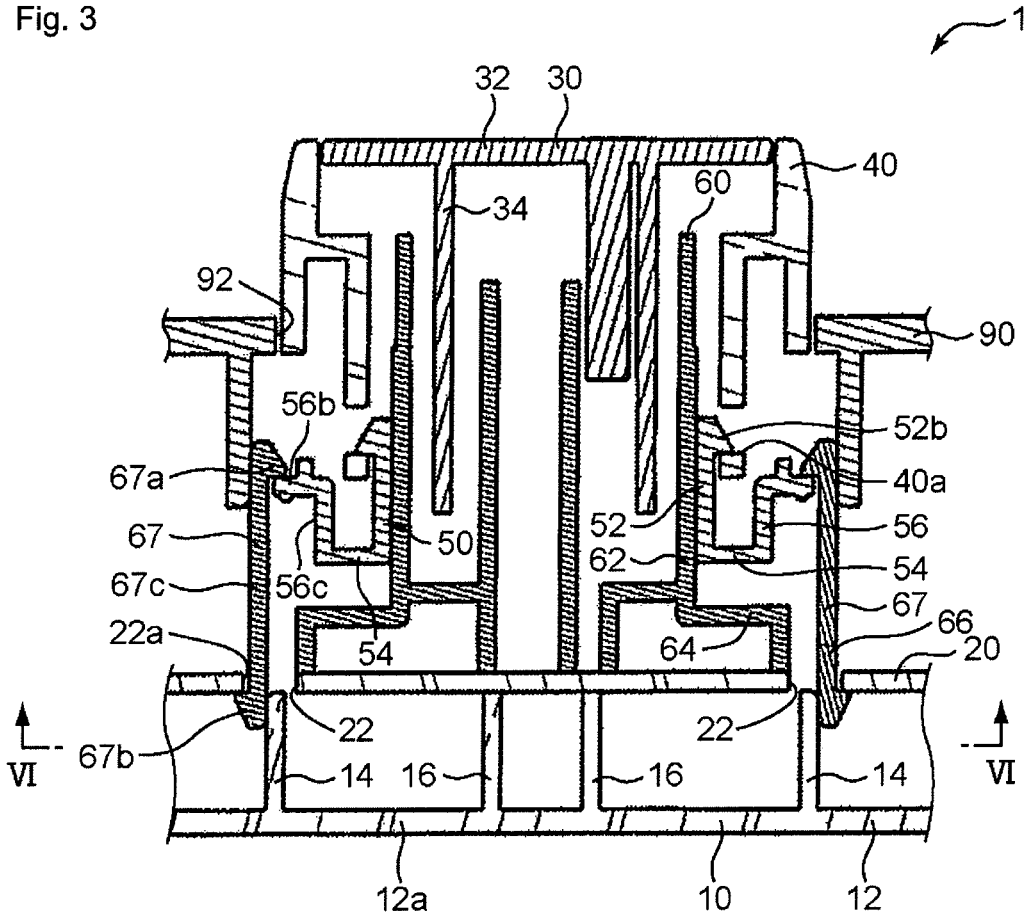
FIG. 3 is a cross-sectional view along a line III-III in FIG. 1.
Figure 4:
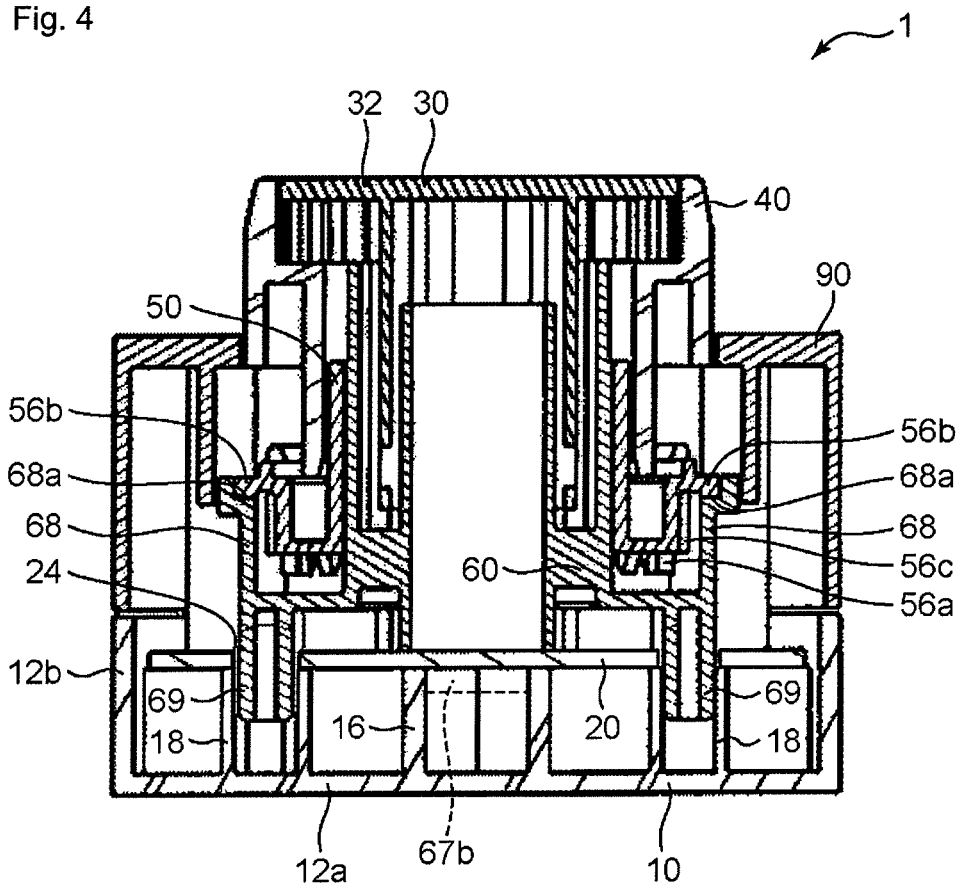
FIG. 4 is a cross-sectional view along a line IV-IV in FIG. 1.
Figure 5:
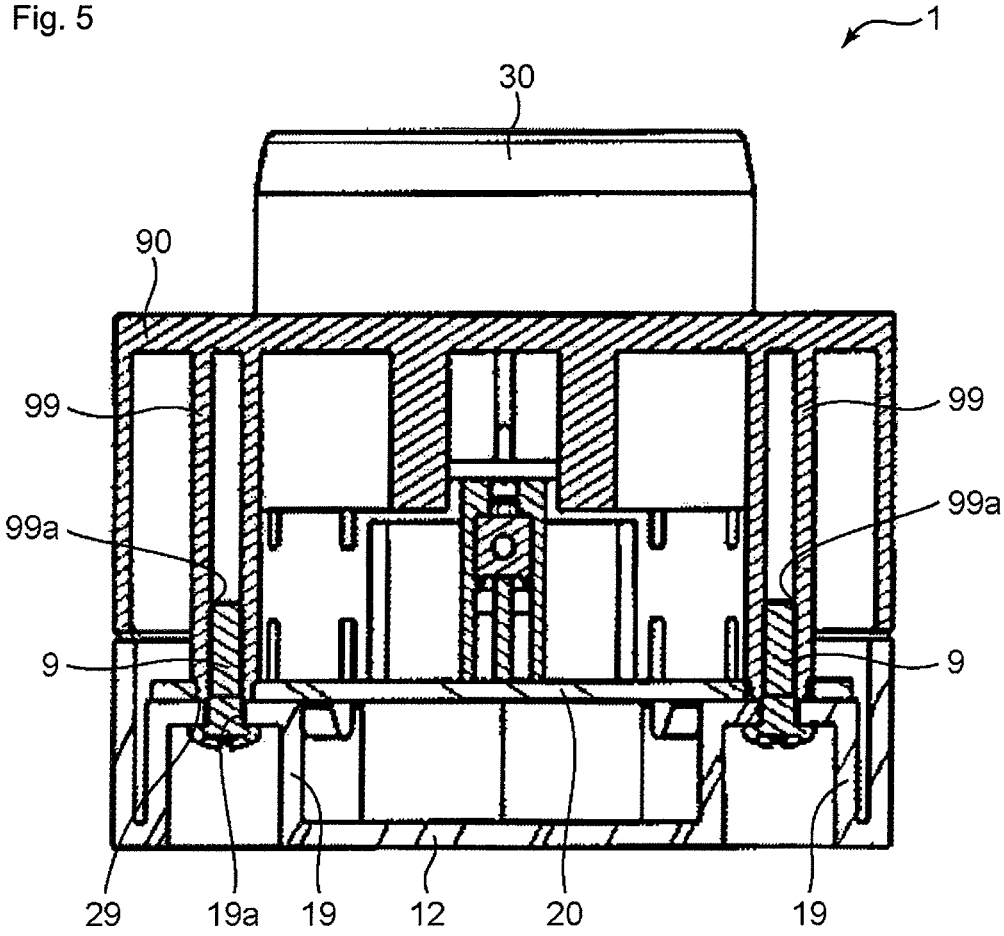
FIG. 5 is a cross-sectional view along a line V-V in FIG. 1.
Figure 6:
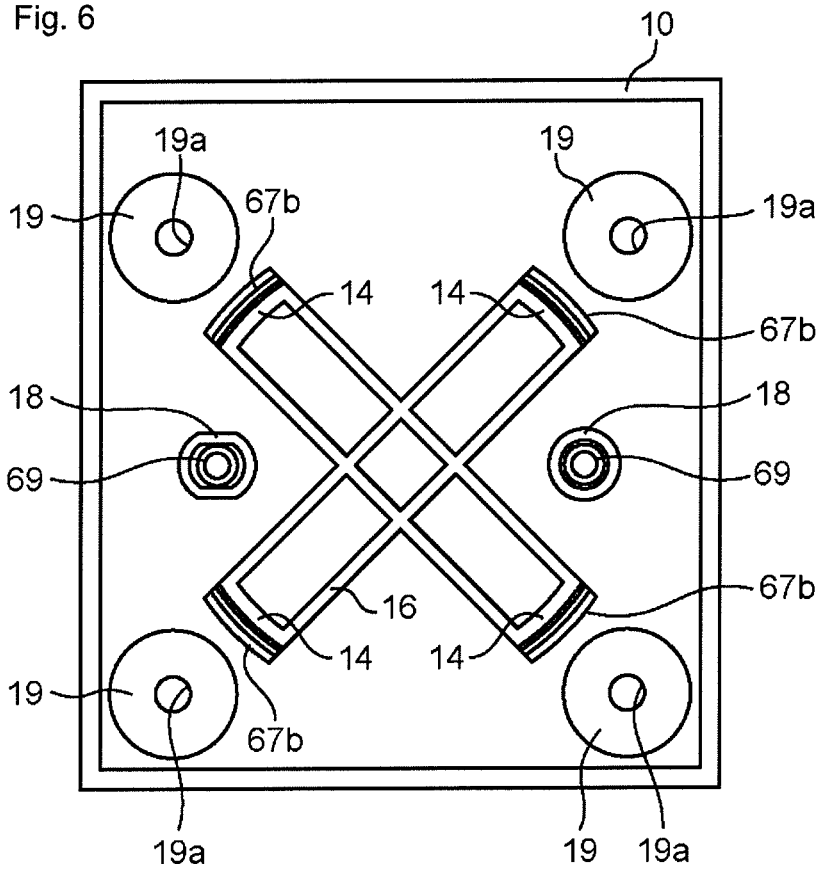
FIG. 6 is a cross-sectional view along a line VI-VI in FIG. 3.

FIG. 3 is a cross-sectional view along a line III-III in FIG. 1. FIG. 4 is a cross-sectional view along a line IV-IV in FIG. 1. FIG. 5 is a cross-sectional view along a line V-V in FIG. 1. FIG. 6 is a cross-sectional view along a line VI-VI in FIG. 3.

The operation apparatus 1 includes a panel 90, a rear cover 10, a circuit board 20, a cap 30, a rotation operation knob 140, a holding member 60, a spring 82, and a plunger 84 fixated on a foremost end of the spring 82. The rotation operation knob 140 includes a dial 40 and a dial holder 50. A switch element 70 is mounted on the circuit board 20.

The holding member 60 holds the rotation operation knob 140 between the panel 90 and the rear cover 10. In this held state, the rotation operation knob 140 is able to rotate centered on a rotation axis L that extends in a predetermined direction. When the rotation operation knob 140 receives a rotation operation, the rotation operation knob 140 rotates and operates the switch element 70. The switch element 70 outputs a signal corresponding to a rotation amount of the rotation operation knob 140. In the present embodiment, the panel 90, the rear cover 10, and the circuit board 20 are each substantially plate-shaped members. The panel 90, the rear cover 10, and the circuit board 20 extend in mutually parallel directions. The rotation axis L extends orthogonally to the panel 90, the rear cover 10, and the circuit board 20.

A configuration of the panel 90 is described.

When the operation apparatus 1 is installed in an automobile, for example, the panel 90 configures a portion of an instrument panel in the automobile. An operation knob through-hole 92 is formed in a center of the panel 90 running through both faces of the panel 90. As shown in FIG. 5, a plurality of rear cover mounts 99 are provided on the panel 90. The rear cover mounts 99 extend rearward from the panel 90. The rear cover mounts 99 hold the rear cover 10 and the circuit board 20. A screw hole 99*a*, into which a screw 9 threadably mounts, is formed on a rear end of each of the rear cover mounts 99. In the present embodiment, four rear cover mounts 99 are provided at mutually equal intervals around a circumference centered on the rotation axis L.

A configuration of the circuit board 20 is described.

The circuit board 20 is positioned on a reverse side, i.e., to the rear, of the panel 90. Formed on the circuit board 20 running through both faces thereof are a plurality of through-holes 22, a plurality of positioning holes 24, and a plurality of board-side screw insertion holes 29. In the present embodiment, four through-holes 22, two positioning holes 24, and four board-side screw insertion holes 29 are formed on the circuit board 20. The four through-holes 22 are formed at mutually equal intervals around a circumference centered on the rotation axis L. The through-holes 22 extend a predetermined amount along a circumferential direction centered on the rotation axis L. The two positioning holes 24 are formed at mutually equal intervals around a circumference centered on the rotation axis L. The positioning holes 24 each have a substantially circular shape. The screw 9 which threads into the rear cover mount 99 is inserted into the board-side screw insertion hole 29. The board-side screw insertion holes 29 are formed at portions on the circuit board 20 corresponding to the rear cover mounts 99. The board-side screw insertion holes 29 are formed further outward in a rotation diameter direction of the rotation operation knob 140 than the insertion holes 22. The circuit board 20 is attached to the panel 90 by inserting the screws 9 through the board-side screw insertion holes 29, then threadably mounting the screws 9 into the screw holes 99*a* on the rear cover mounts 99.

A configuration of the switch element 70 is described.

The switch element 70 includes a switch element main body 72 and a detector head 74. The switch element main body 72 is fixated on the circuit board 20. In this fixed state, the switch element main body 72 projects in an obverse direction (i.e., forward) from the circuit board 20. The detector head 74 projects further forward from the switch element main body 72. When the detector head 74 receives a force in a direction parallel to the circuit board 20 while in an erected state projecting forward, the detector head 74 retreats in a direction parallel to the circuit board 20. When the force is removed, the detector head 74 reverts to the erected state. The switch element main body 72 outputs a predetermined signal each time the detector head 74 retreats.

A configuration of the rotation operation knob 140 is described.

As described above, the rotation operation knob 140 includes a dial 40 and a dial holder 50.

The dial 40 is gripped by a user, for example, and receives a rotation operation from the user. The dial 40 has a substantially circular tubular shape extending in the rotation axis L direction, centered on the rotation axis L. A dial latching hole 40*a* is provided on a rear end portion of the dial 40. The dial latching hole 40*a* is latched to the dial holder 50. The dial 40 is inserted within the rotation operation knob through-hole 92 on the panel 90. In this inserted state, a front portion of the dial 40 projects further forward than the panel 90. The user grips the front portion of the dial 40 and operates the dial 40.

The dial holder 50 includes an inner cylinder 52, an outer cylinder 56, and a plurality of connectors 54. Each of the connectors 54 connects the inner cylinder 52 and the outer cylinder 56. The inner cylinder 52, the outer cylinder 56, and the connectors 54 are molded so as to be integral with one another.

The inner cylinder 52 has a substantially circular tubular shape extending in the rotation axis L direction, centered on the rotation axis L.

A dial latched projection 52*b* is provided on an outer circumferential surface of the inner cylinder 52. The dial latched projection 52*b* mates and latches with the dial latching hole 40*a* on the dial 40. Through this latching, the inner cylinder 52 (i.e., the dial holder 50) is connected with the dial 40 so as to be capable of integral rotation with the dial 40. In this connected state, a front portion of the inner cylinder 52 is inserted to an interior of the dial 40.

The outer cylinder 56 has a substantially circular tubular shape extending in the rotation axis L direction, centered on the rotation axis L. The outer cylinder 56 has a diameter larger than the inner cylinder 52. The outer cylinder 56 surrounds the inner cylinder 52.

A plurality of switch operation projections 56*a* are provided on a rear end of the outer cylinder 56 and the connectors 54. The switch operation projections 56*a* project rearward from a rear end surface of the outer cylinder 56 and a rear end surface of the connectors 54. The switch operation projections 56*a* are aligned at equal intervals in a rotation circumference direction centered on the rotation axis L. The switch element 70 is disposed around a circumference where the switch operation projections 56*a* are aligned. The detector head 74 of the switch element 70 is disposed in a posture where the detector head 74 retreats along a rotation circumference direction of the switch operation projections 56*a*. The switch operation projections 56*a* contact the detector head 74 of the switch element 70 each time the switch operation projections 56*a* pass the switch element 70, causing the detector head 74 to retreat. Thereby, the switch element 70 outputs a signal corresponding to a passage amount of the switch operation projections 56*a*, i.e., the rotation amount of the rotation operation knob 140 which is configured from the dial holder 50 and the dial 40.

Moreover, the switch element 70 may also output a signal which differs in response to a difference in a retreat direction of the detector head 74 (that is, the rotation direction of the rotation operation knob 140). Also, the switch element 70 may output a signal only when retreat is in one direction, i.e., only when the rotation operation knob 140 is rotated in one of either a positive rotation direction or a negative rotation direction.

A flange 56*b* spreading outward in the rotation diameter direction is provided to a front end of the outer cylinder 56. An outer circumferential end of the flange 56*b* extends parallel to the circuit board 20 around the entire circumference thereof.

In addition to the spring 82 and the plunger 84, an outer circumferential surface 56*c* of a portion on the outer cylinder 56 between the switch operation projections 56*a* and the flange 56*b* configures an operational feedback imparting mechanism. The operational feedback imparting mechanism gives the user favorable operational feedback. Protrusions projecting to an exterior are formed at equal intervals in the circumferential direction on the outer circumferential surface 56*c* of the outer cylinder 56.

The spring 82 is fixated on the holding member 60 in a state of compression deformation in a direction parallel to the circuit board 20. The plunger 84 is fixated to a foremost end of the spring 82. The plunger 84 is pressed against the outer circumferential surface 56*c* of the outer cylinder 56 due to the elastic opposing force of the spring 82. When the dial holder 50 rotates in conjunction with rotation of the dial 40, the portion of the outer circumferential surface 56*c* on the outer cylinder 56 against which the plunger 84 is pressed changes between the protrusions described above and portions between the protrusions. Accompanying this change in the pressed portion, the spring 82 extends and contracts in a direction parallel to the circuit board 20. Accompanying the extension and contraction of the spring 82, the force applied to the dial holder 50 and the dial 40 from the spring 82 changes. This change in the force imparts a favorable clicking sensation to the user.

The connectors 54 extend diametrically outward from the rear end portion of the inner cylinder 52 to the rear end portion of the outer cylinder 56. The connectors 54 connect the rear end portion of the inner cylinder 52 and the rear end portion of the outer cylinder 56 with each other. In the present embodiment, each of the connectors 54 is provided at mutually equal intervals around a circumference centered on the rotation axis L.

A configuration of the cap 30 is described.

The cap 30 covers an open portion at a front end of the dial 40. An obverse surface 32 of the cap 30 has a circular plate shape centered on the rotation axis L. A square tube 34 extends rearward from the reverse side of the obverse surface 32. The square tube 34 has a square tubular shape surrounding the rotation axis L. The cap 30 is held by the holding member 60 in a position surrounded by the interior surface of the dial 40. In this held state, the obverse surface 32 of the cap 30 covers the open portion on the front end of the dial 40.

A configuration of the holding member 60 is described.

In addition to holding the rotation operation knob 140 so as to be capable of rotation, the holding member 60 holds the cap 30. The holding member 60 includes an interior holder 62, an exterior holder 66, a holding member connector 64, and a plurality of positioning bosses (rear cover holders) 69. The holding member connector 64 connects the interior holder 62 with the exterior holder 66. The interior holder 62, the exterior holder 66, the holding member connector 64, and the positioning bosses 69 are molded so as to be integral with one another.

The interior holder 62 has a substantially circular tubular shape centered on the rotation axis L. The interior holder 62 holds the square tube 34 of the cap 30 so as to be incapable of rotation. In this held position, the obverse surface 32 of the cap 30 covers the open portion on the front end of the dial 40. The interior holder 62 is inserted to a diametrical interior of the dial holder 50. In this inserted position, the interior holder 62 regulates movement of the dial holder 50 in the diameter direction. When the dial holder 50 receives a rotation operation through the dial 40, the interior surface of the dial holder 50 slides along the outer circumferential surface of the interior holder 62. Then, the dial holder 50 rotates around the rotation axis L.

The exterior holder 66 has a substantially circular tubular shape extending in the rotation axis L direction, centered on the rotation axis L. The exterior holder 66 has a diameter larger than the interior holder 62. The exterior holder 66 surrounds the interior holder 62. The exterior holder 66 includes a plurality of latched portions 67 and a plurality of holder supports 68.

The holder supports 68 extend along a front-back direction and a rotation circumference direction. In the present embodiment, four holder supports 68 are provided at mutually equal intervals in the rotation circumference direction. A holder support surface 68*a* is formed on a front end portion of each of the holder supports 68 extending parallel to the circuit board 20 and also along the rotation circumference direction. The holder support surface 68*a* contacts a rear end surface of the flange 56*b* on the dial holder 50 from the rear. Due to this contact, rearward movement of the dial holder 50 is regulated.

The latched portions 67 are plate-shaped members extending in the front-back direction and in the rotation circumference direction. At the through-holes 22 formed on the circuit board 20, the latched portions 67 are respectively provided at positions corresponding to the through-holes 22. The latched portions 67 are inserted through the respective through-holes 22. In the present embodiment, the four latched portions 67 are provided at mutually equal intervals in the rotation circumference direction, corresponding to the through-holes 22.

The latched portions 67 include a plate 67*c*, a latching projection 67*a*, and a latched projection 67*b*. The plate 67*c* extends in the front-back direction. The latching projection 67*a* is provided to a front end of the latched portion 67. The latching projection 67*a* projects diametrically inward further than the interior surface in the rotation diameter direction of the plate 67*c*. The latched projection 67*b* is provided on a rear end of the latched portion 67. The latched projection 67*b* projects diametrically outward further than the exterior surface in the rotation diameter direction of the plate 67*c*.

Each of the latched portions 67 is positioned between the holder supports 68 and is supported by the holder supports 68. Each of the latched portions 67 is connected to and supported by the holder supports 68 only at a central portion thereof in the front-back direction. Accordingly, each of the latched portions 67 is readily flexure deformable in the rotation diameter direction centered on the central portion in the front-back direction.

The latching projections 67*a* regulate forward movement of the flange 56*b* on the dial holder 50. Each of the latching projections 67*a* contacts the front end surface of the flange 56*b* on the dial holder 50 from the front and thus regulates forward motion of the flange 56*b*.

Specifically, the plate 67*c* is positioned further outward in the rotation diameter direction than the flange 56*b*. Each of the latching projections 67*a* projects to a position further inward in the rotation diameter direction than the flange 56*b*. Accompanying flexure deformation of a front portion of each of the latched portions 67 outward in the rotation diameter direction, each of the latching projections 67*a* displaces to a position further outward in the rotation diameter direction than the flange 56*b*. Thereby, insertion of the dial holder 50 to a region bounded by the latching projections 67*a* is enabled. When the dial holder 50 is inserted into the region and, moreover, moves rearward further than the latching projections 67*a*, the latched portions 67 elastically recover. Then, the latched portions 67 return to the position inward further in the rotation diameter direction than the flange 56*b* and contact the front end surface of the flange 56*b*.

In this way, the rotation diameter direction and the front-back direction movement of the dial holder 50 is regulated by the interior holder 62 of the holding member 60, the holder supports 68 of the exterior holder 66, and the latching projections 67*a* of the latched portions 67. The dial holder 50 is thus held by the holding member 60 so as to be capable of rotation.

Each of the latched projections 67*b* is latched to the circuit board 20. The latched projections 67*b* are inserted through the through-holes 22 on the circuit board 20. In this inserted state, the latched projections 67*b* are disposed in positions contacting a rear end surface of the circuit board from behind. Due to this contact, movement of the latched projections 67*b* further forward than the circuit board 20 is regulated.

Specifically, a width in the rotation diameter direction of the latched projections 67*b* is set to a dimension smaller than a width in the rotation diameter direction of the through-holes 22. A width in the rotation circumference direction of the latched projections 67*b* is set to a dimension largely equal to a width in the rotation circumference direction of the through-holes 22. In this way, the latched projections 67*b* have a shape which enables insertion through the through-holes 22 on the circuit board 20. The plate 67*c* is positioned further inward in the rotation diameter direction than a surface 22*a* on an exterior in the rotation diameter direction of the through-holes 22. The latched projections 67*b* project to a position further outward in the rotation diameter direction than the exterior surface 22*a* of the through-holes 22.

Accompanying flexure deformation of a rear portion of the latched portion 67 inward in the rotation diameter direction, each of the latched projections 67*b* displaces to a position further inward in the rotation diameter direction than the exterior surface 22*a* of the through-holes 22. Thereby, each of the latched projections 67*b* is inserted through the through-holes 22. In other words, each of the latched projections 67*b* passes through the through-holes 22 and moves toward the rear of the circuit board 20. Thereafter, when the latched portions 67 elastically recover, each of the latched projections 67*b* moves to a position further outward in the rotation diameter direction than the exterior surfaces 22*a* of the through-holes 22. Then, each of the latched projections 67*b* contacts the reverse surface of the circuit board 20 and is latched to the circuit board 20.

A surface on an exterior in the rotation diameter direction of the latched projection 67*b* is inclined further outward in the rotation diameter direction further forward. Therefore, the latched projection 67*b* is able to easily pass through the through-hole 22 from the front. The front end surface of the latched projection 67*b* also extends parallel to the circuit board 20. Therefore, the latched projection 67*b* is stably latched to the circuit board 20 due to the contact of the front end surface with the rear end surface of the circuit board 20.

In this way, by latching the latched projections 67*b* to the circuit board 20, the holding member 60 is latched to the circuit board 20 by regulating forward movement thereof. Herein, in a state where the latched projections 67*b* are latched to the circuit board 20, the plate 67*c* of the latched portion 67 is inserted through the through-holes 22. Also, both end surfaces in the rotation circumference direction of the plate 67*c* contact both end surfaces in the rotation circumference direction of the interior surface of the through-holes 22. This contact regulates movement of the holding member 60 in the rotation circumference direction.

The holding member connector 64 extends from the rear end portion of the interior holder 62 diametrically outward to a rear end portion of the exterior holder 66. The holding member connector 64 connects the rear end portion of the interior holder 62 and the rear end portion of the exterior holder 66 with each other. The holding member connector 64 connects the interior holder 62 and the exterior holder 66 across the entire rotation circumference direction.

The positioning boss 69 is a substantially circular columnar member. The positioning boss 69 extends rearward from the rear end surface of the holding member connector 64. The positioning boss 69 is inserted into the positioning hole 24 formed on the circuit board 20. The positioning boss 69 has a shape which is capable of being inserted into the positioning hole 24. The positioning bosses 69 are respectively provided at positions corresponding to the positioning holes 24. In the present embodiment, two positioning bosses 69 are provided at mutually equal intervals in the rotation circumference direction, corresponding to the positioning holes 24. The positioning bosses 69 are inserted into the positioning hole 24 in a state where the positioning bosses 69 project rearward from the rear end surface of the circuit board 20. To the rear of the circuit board 20, the positioning bosses 69 are inserted within boss receivers 18, described hereafter, on the rear cover 10.

A configuration of the rear cover 10 is described.

The rear cover 10 covers the circuit board 20 from the reverse side. The rear cover 10 includes a shield 12, a plurality of deformation regulators 14, reinforcements 16, a plurality of boss receivers 18, and a plurality of panel mounts 19.

The shield 12 is a box-shaped member having a bottom 12*a* and an exterior wall 12*b*. The bottom 12*a* extends parallel to the circuit board 20. The exterior wall 12*b* projects toward the circuit board 20 from an outer circumference of the bottom 12*a*. The shield 12 is disposed in a position where the bottom 12*a* covers the circuit board 20 from the reverse side. In this disposed position, the circuit board 20 is accommodated within a region bounded by the exterior wall 12*b*.

The screw 9 which threads into the rear cover mount 99 is inserted through the panel mount 19. The panel mount 19 has a circular columnar shape with closed ends projecting forward from the bottom 12*a* of the shield 12. A rear-cover-side screw insertion hole 19*a* is formed on an obverse end portion configuring an end of the panel mount 19, the rear-cover-side screw insertion hole 19*a* running through a center thereof in the front-back direction. The screw 9 is able to be inserted in the rear-cover-side screw insertion hole 19*a*. The panel mount 19 is provided in a position corresponding to the rear cover mount 99. In the present embodiment, four panel mounts 19 are provided. The screw 9 is inserted through the rear-cover-side screw insertion hole 19*a* and threads into the screw hole 99*a* on the rear cover mount 99. Thereby, the rear cover 10 is attached to the panel 90. More specifically, in a state where the screw 9 is inserted through the rear-cover-side screw insertion hole 19*a* and, in addition, the screw 9 is inserted through the board-side screw insertion hole 29 formed on the circuit board 20, the screw 9 is threaded into the screw hole 99*a* of the rear cover mount 99. Thereby, the rear cover 10 is attached to the panel 90 in a state where the circuit board 20 is sandwiched between the panel 90 and the rear cover 10. Herein, in order to more easily attach the rear cover 10 to the panel 90, the hole diameter of the rear-cover-side screw insertion hole 19*a* is set to be larger than the exterior diameter of the screw 9. Therefore, the rear cover 10 is capable of relative displacement with the circuit board in a direction parallel to the circuit board 20 with respect to the panel 90.

The deformation regulators 14 contact each of the latched projections 67*b* on the holding member 60. The deformation regulators 14 regulate displacement of the latched projections 67*b* through contact. In the present embodiment, four deformation regulators 14 are provided at mutually equal intervals along the rotation circumference direction, corresponding to the four latched projections 67*b*.

The deformation regulator 14 is a plate-shaped member. The deformation regulator 14 projects forward from the bottom 12*a* of the shield 12, i.e., toward the circuit board 20, and extends along the rotation circumference direction. Specifically, in a state where the rear cover 10 is attached to the panel 90, the deformation regulator 14 extends forward further than a rear end of the latched projections 67*b* which are latched to the circuit board 20. Also, the exterior surface in the rotation diameter direction of the deformation regulator 14 makes surface contact with the interior surface in the rotation diameter direction of the latched projection 67*b* which is latched to the circuit board 20. In this way, the deformation regulator 14 regulates displacement of the latched projection 67*b* inward in the rotation diameter direction by the exterior surface of the deformation regulator contacting the interior surface of the latched projection 67*b*. In the present embodiment, the exterior surface of the deformation regulator 14 contacts the interior surface of the latched projection 67*b* in a state where the latched portion 67 is not flexure deformed and the latched projection 67*b* is not displaced.

As described above, the latched projection 67*b* can pass through the through-hole 22 by displacing diametrically inward accompanying flexure deformation of the latched portion 67. Accordingly, due to the deformation regulator 14 regulating diametrically inward movement of the latched projection 67*b*, passage through the through-hole 22 becomes impossible for the latched projection 67*b*. That is, the latched projection 67*b* is restricted in a state of being latched to the circuit board 20.

The reinforcements 16 inhibit deformation of the deformation regulators 14. The reinforcements 16 are plate-shaped members extending in the rotation diameter direction. The reinforcements 16 connect ends in the circumference direction of mutually opposing deformation regulators 14 with each other. Specifically, the reinforcements 16 extend diametrically inward from the deformation regulators 14 and regulate diametrically inward deformation of the deformation regulators 14. Thereby, diametrically inward displacement of the latched projections 67*b* which are in contact with the deformation regulators 14 is more reliably regulated.

The positioning bosses 69 are inserted to the interior of the boss receivers 18. In the present embodiment, two boss receivers 18 are provided, corresponding to the two positioning bosses 69. The boss receivers 18 have a substantially circular tubular shape projecting from the bottom 12*a* of the shield 12, i.e., toward the circuit board 20. In the present embodiment, the boss receivers 18 extend to a position contacting the reverse surface of the circuit board 20.

The inner diameter of the boss receiver 18 is set to a size in which the outer circumferential surface of the positioning boss 69 contacts the inner circumferential surface of the boss receiver 18. Therefore, by inserting the positioning boss 69 into the boss receiver 18, the outer circumferential surface of the positioning boss 69 contacts the inner circumferential surface of the boss receiver 18. Thereby, the rear cover 10 having the boss receivers 18 is held by the holding member 60 such that relative displacement with the holding member 60 in a direction parallel to the circuit board 20 is impossible.

In a state where the deformation regulators 14 contact the latched projections 67*b*, the boss receivers 18 are provided in positions where the positioning bosses 69 are inserted to an interior thereof. Therefore, in a state where the positioning boss 69 is inserted to the boss receiver 18, the rear cover 10 is held by the holding member 60 in a position where the deformation regulators 14 contact the latched projections 67*b* and such that relative displacement with the holding member 60 in a direction parallel to the circuit board 20 is impossible.

Herein, the positioning bosses 69 extend further to the rear than the latched projections 67*b*. Meanwhile, the deformation regulators 14 and the boss receivers 18 extend forward to largely the same position. Accordingly, when the rear cover 10 is disposed on the reverse side of the circuit board 20, the positioning bosses 69 are first inserted within the boss receivers 18. Due to this insertion, the rear cover 10 is held by the holding member 60. Also, by pressing the rear cover 10 out forward from this state, each of the deformation regulators 14 moves forward while sliding along the latched projections 67*b*. Then, contact between each of the deformation regulators 14 and the latched projections 67*b* is achieved. In the present embodiment, a front end portion of the diametrically exterior surface of the deformation regulator 14 is inclined so as to separate from the latched projection 67*b* further forward. The rear end portion of the diametrically interior surface of the latched projection 67*b* is inclined so as to separate from the deformation regulator 14 further rearward. Therefore, the deformation regulators 14 are able to easily slide along the latched projections 67*b*.

As described above, in the present operation apparatus 1, while the latched portion 67 of the holding member 60 is flexure deformed and the latched projection 67*b* is thus displaced inward in the rotation diameter direction, the latched projection 67*b* is inserted through the through-hole 22. In addition, through the simple work of attaching the rear cover 10 to the panel 90, the latched projections 67*b* are restricted to a state of being latched to the circuit board 20. This restriction more reliably inhibits detachment of the holding member 60 from the circuit board 20.

In particular, the deformation regulators 14 are provided to the rear cover 10. Therefore, simply by attaching the rear cover 10 to the panel 90 as described above, the deformation regulators 14 can restrict the latched projections 67*b* to a state of being latched to the circuit board 20. Moreover, compared to a case where the deformation regulators 14 are configured as components separate from the rear cover 10, the number of components can be kept low.

Herein, relative positions of the deformation regulators 14 and the latched projections 67*b* are not limited to the above. The deformation regulators 14 may regulate displacement of the latched projections 67*b* to a predetermined amount and a specified direction enabling passage through the through-holes 22. The specified direction is a direction opposite to the projection direction of the latched projections 67*b* and is a direction enabling insertion of the latched projections 67*b* through the through-holes 22. For example, in a state where the latched portion 67 is flexure deformed in a direction opposite to the specified direction and the latched projections 67*b* are displaced in a direction opposite to the specified direction, the deformation regulators 14 may contact the latched projections 67*b* undergoing displacement.

In addition, the deformation regulators 14 may separate from the non-displaced latched projections 67*b* in the specified direction, as long as the separation is a range less than the predetermined amount. However, in a case where the deformation regulators 14 contact the latched projections 67*b* in the non-displacing state, escape of the latched projections 67*b* through the through-holes 22 can be more reliably inhibited. In a case where the deformation inhibitors 14 contact the latched projections 67*b* in a flexure-deformed state, excessive stress is imparted to the latched projections 67*b*. In contrast, in a case where the deformation regulators 14 contact the latched projections 67*b* in the non-displacing state, excessive stress is not imparted to the latched projections 67*b*.

In addition, the projection direction of the latched projections 67*b* is not limited to the above. For example, the latched projections 67*b* may project inward in the rotation diameter direction. In such a case, the deformation regulators 14 have a shape which contacts the latched projections 67*b* from the exterior in the diameter direction.

In addition, the number and placement of the latched projections 67*b* are not limited to the above. However, in a case where the latched projections 67*b* are disposed in positions at mutually equal intervals in the rotation circumference direction, the holding member 60 is latched to the circuit board 20 with more stability.

In addition, the specific configuration in which the holding member 60 holds the rear cover 10 is not limited to a configuration in which the positioning bosses 69 are inserted into the boss receivers 18. In addition, a configuration in which the holding member 60 holds the rear cover may be omitted. However, in a case where the rear cover 10 is held by the holding member 60, the deformation regulators 14 are disposed more reliably and more readily at positions where displacement of the latched projections 67*b* is regulated. In particular, such a configuration is effective in a case where the rear cover 10 is attached so as to be capable of mutual displacement with respect to the panel 90 and the rear cover 10 is not positioned with respect to the panel 90.

In addition, a configuration in which the holding member 60 holds the rotation operation knob 140 is not limited to the above. The specific configuration of the rotation operation knob 140 is also not limited to the above. The specific configuration of the switch element 70 is also not limited to the above.

Figure 7:
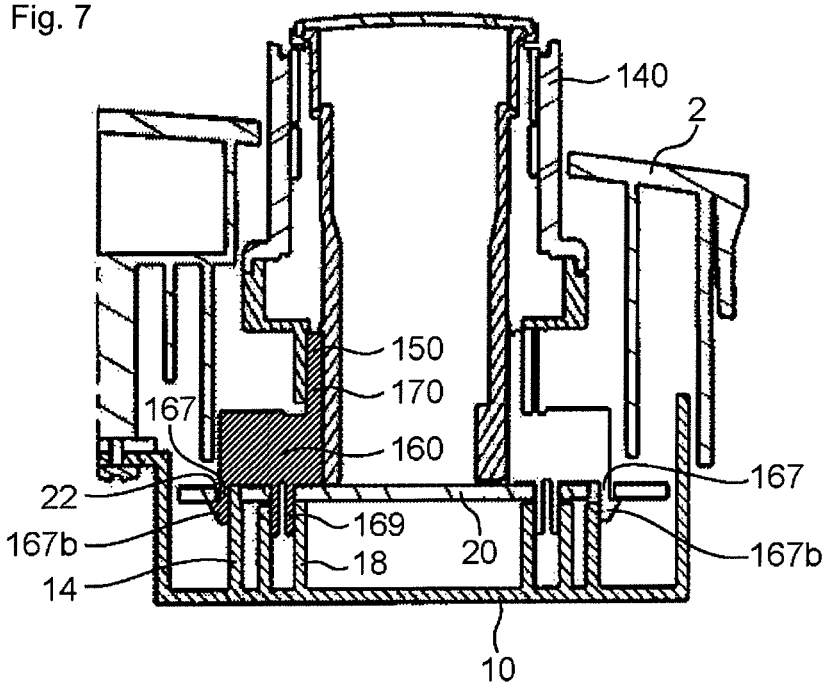
FIG. 7 is a schematic cross-sectional view of an operation apparatus according to another embodiment of the present invention.
Figure 8:
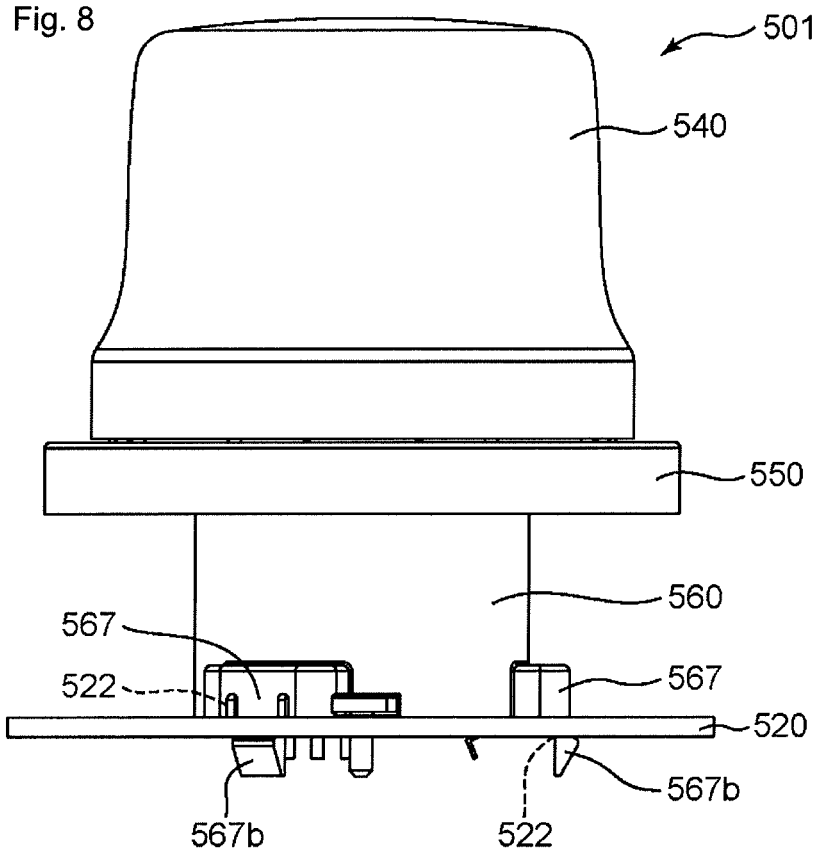
FIG. 8 is a lateral view of a conventional operation apparatus.

For example, as shown in FIG. 7, in place of the holding member 60 and the switch element 70, and the like, a rotary encoder element 150 including functions of the holding member 60 and the switch element 70 may be employed. In FIG. 7, structural elements other than the rotary encoder 150 are the same as the operation apparatus according to the above embodiment. In FIG. 7, structural elements which are the same as in the above embodiment are given the same reference numbers.

The rotary encoder element 150 includes a holder 160, a detector head 170, and an outputter. The holder 160 holds the rotation operation knob 140 and acts as the holding member 60. The detector head 170 is held by the holder 160 so as to be capable of rotation in a state where the detector head 170 is connected to the rotation operation knob 140 so as to be integrally rotatable with the rotation operation knob 140. The outputter outputs a signal corresponding to a rotation amount of the detector head 170.

A positioning boss 169 and a latched portion 167 having a latched projection 167*b* are provided to a rear end of the holder 160. The positioning boss 169 is inserted into the boss receiver 18. The latched projection 167*b* is latched to the circuit board 20 in a state inserted through the through-hole 22. The deformation regulator 14 on the rear cover 10 contacts the latched projection 167*b*. Through this contact, displacement of the latched projection 167*b* is regulated. In this way, the rotary encoder element 150 is held on the circuit board 20 in a state where detachment from the circuit board 20 is inhibited by the regulation described above.

As described above, the present invention provides an operation apparatus including a panel; a circuit board on which a through-hole is formed passing through both surfaces thereof, the circuit board positioned on a reverse side of the panel in a state where a switch element is mounted to the circuit board; a rotation operation knob which is rotated centered on a predetermined rotation axis and which thereby operates the switch element; a holding member which includes a latched portion extending in a front-back direction of the circuit board and capable of being inserted through the through-hole formed on the circuit board and which also holds the rotation operation knob so as to be capable of rotation; and a rear cover attached to the panel so as to cover the circuit board from the reverse side. The latched portion has a shape capable of flexure deformation in a specified line parallel to the circuit board and includes a latched projection on an end on a reverse side thereof projecting in a first direction of the specified line. Accompanying flexure deformation of the latched portion in a second direction of the specified line, the second direction being opposite to the first direction, the latched projection is able to pass through the through-hole by displacing a predetermined amount in the second direction of the specified line. In addition, the latched projection has a shape which is latched to the circuit board by contact from the reverse side with the reverse surface of the circuit board accompanying elastic recovery by the latched portion after passage through the through-hole. The rear cover has a deformation regulator which projects toward the reverse surface of the circuit board and which is capable of contact with the latched projection from the second direction of the specified line. In a state where the latched projection is latched to the circuit board and where the rear cover is attached to the panel, the deformation regulator regulates displacement of the latched projection in the second direction of the specified line to less than the pre-determined amount by contact with the latched projection.

In this operation apparatus, the latched projection passes through the through-hole on the circuit board due to flexure deformation of the latched portion. The latched projection is latched to the circuit board accompanying elastic recovery of the latched portion after passage through the through-hole. Then, the deformation regulator provided to the rear cover contacts the latched projection latched to the circuit board and thus regulates the displacement of the latched projection in the second direction of the specified line to less than the pre-determined amount. Therefore, through the simple work of inserting the latched projection through the through-hole while flexure deforming the latched portion, the latched projection can be latched to the circuit board and the holding member can be attached to the circuit board. Moreover, by attaching the rear cover to the panel, passage of the latched projection through the through-hole is inhibited by the deformation regulator. That is, detachment of the holding member from the circuit board is inhibited. In this way, with the operation apparatus, the work of attaching the holding member to the circuit board is facilitated while separation of the holding member from the circuit board is more reliably inhibited.

Moreover, the deformation regulator is provided to the rear cover provided to the operation apparatus in order to cover the reverse side of the circuit board. Therefore, compared to a case where the deformation regulator is configured by a component separate from the rear cover, an increase in the number of components is inhibited.

In the present invention, the deformation regulator preferably has a shape where, in a state where the latched projection is latched to the circuit board and where the rear cover is attached to the panel, the deformation regulator contacts the latched projection at a position where the latched portion is not flexure deformed.

With this configuration, the latched portion is not flexure deformed in a state where the deformation regulator and the latched projection are in contact. Therefore, excessive stress is inhibited from being imparted to the latched projection and the latched portion.

In addition, in the present invention, the rear cover is preferably attached to the panel so as to be capable of mutual displacement with the circuit board in a direction parallel to the circuit board. The holding member preferably includes a rear cover holder which holds the rear cover in a position where the deformation regulator regulates displacement of the latched projection which is latched to the circuit board in the second direction of the specified line.

With this configuration, the rear cover is positioned more reliably at a position where the deformation regulator regulates displacement of the latched projection in the other direction. Therefore, escape of the latched projection through the through-hole is more reliably inhibited by the deformation regulator.

In addition, in the present invention, a plurality of the latched portions are preferably provided at positions at mutually equal intervals in the rotation circumference direction of the rotation operation knob and the through-holes are preferably formed on the circuit board at portions corresponding to each of the latched portions.

With this configuration, the holding member (i.e., the rotation operation knob) is latched to the circuit board with more stability.

The invention claimed is:

1. An operation apparatus comprising:

a panel;

a circuit board in which a through-hole is formed passing through both surfaces of the circuit board, the circuit board positioned on a rear side of the panel with a switch element is mounted to the circuit board;

a rotation operation knob which is rotated centered on a predetermined rotation axis thereby operates the switch element; and a holding member that includes a latched portion which extends in a front-back direction of the circuit board and is able to be inserted through the through-hole formed in the circuit board, the holding member holding the rotation operation knob so as to be capable of rotation; and a rear cover attached to the panel so as to cover the circuit board from the rear side, wherein the latched portion has a shape capable of flexure deformation along a specified line parallel to the circuit board and includes a latched projection on a rear end of the latched portion projecting in a first direction of the specified line, by flexure deformation of the latched portion in a second direction of the specified line, opposite to the first direction, the latched projection is able to pass through the through-hole by displacing a predetermined amount in the second direction of the specified line, and the latched projection has a shape which is latched to the circuit board by contact with the rear surface of the circuit board by elastic recovery of the latched portion after passage through the through-hole, the rear cover has a deformation regulator which projects toward the rear surface of the circuit board and which is capable of contact with the latched projection from the second direction of the specified line, and in a condition in which the latched projection is latched to the circuit board and the rear cover is attached to the panel, the deformation regulator regulates displacement of the latched projection in the second direction of the specified line to less than the pre-determined amount by contact with the latched projection.

2. The operation apparatus according to claim 1, wherein the deformation regulator has a shape such that, in a condition in which the latched projection is latched to the circuit board and the rear cover is attached to the panel, the deformation regulator contacts the latched projection at a position in which the latched portion is not flexure deformed.

3. The operation apparatus according to claim 1, wherein:

the rear cover is attached to the panel so as to be capable of mutual displacement with the circuit board in a direction parallel to the circuit board, and the holding member includes a rear cover holder which holds the rear cover in a position where the deformation regulator regulates displacement of the latched projection in the second direction of the specified line, with the latched projection being latched to the circuit board.

4. The operation apparatus according claim 1, wherein a plurality of the latched portions are provided on the holding member at mutually equal intervals in the rotation circumference direction of the rotation operation knob and the through-holes are formed on the circuit board at portions corresponding to each of the latched portions.

5. The operation apparatus according to claim 2, wherein:

the rear cover is attached to the panel so as to be capable of mutual displacement with the circuit board in a direction parallel to the circuit board, and the holding member includes a rear cover holder which holds the rear cover in a position where the deformation regulator regulates displacement of the latched projection in the second direction of the specified line, with the latched projection being latched to the circuit board.

6. The operation apparatus according claim 2, wherein a plurality of the latched portions are provided on the holding member at mutually equal intervals in the rotation circumference direction of the rotation operation knob and the through-holes are formed on the circuit board at portions corresponding to each of the latched portions.

7. The operation apparatus according claim 3, wherein a plurality of the latched portions are provided on the holding member at mutually equal intervals in the rotation circumference direction of the rotation operation knob and the through-holes are formed on the circuit board at portions corresponding to each of the latched portions.

8. The operation apparatus according claim 5, wherein a plurality of the latched portions are provided on the holding member at mutually equal intervals in the rotation circumference direction of the rotation operation knob and the through-holes are formed on the circuit board at portions corresponding to each of the latched portions.

* * * * *